US011585047B2

(12) United States Patent
Pihko et al.

(10) Patent No.: US 11,585,047 B2
(45) Date of Patent: Feb. 21, 2023

(54) METHOD AND APPARATUS FOR PRODUCING A FIBER WEB

(71) Applicant: Teknologian tutkimuskeskus VTT Oy, Espoo (FI)

(72) Inventors: Riku Pihko, Jyväskylä (FI); Jani Lehmonen, Jyväskylä (FI); Kay Rökman, Espoo (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 128 days.

(21) Appl. No.: 17/167,115

(22) Filed: Feb. 4, 2021

(65) Prior Publication Data

US 2021/0156089 A1 May 27, 2021

Related U.S. Application Data

(62) Division of application No. 16/339,476, filed as application No. PCT/FI2017/050696 on Oct. 4, 2017, now Pat. No. 10,954,632.

(30) Foreign Application Priority Data

Oct. 5, 2016 (FI) ..... 20165747

(51) Int. Cl.

| | |
|---|---|
| ***D21F 1/52*** | (2006.01) |
| ***D21F 9/00*** | (2006.01) |
| ***D21F 3/02*** | (2006.01) |
| ***D21F 5/04*** | (2006.01) |
| ***D21F 11/00*** | (2006.01) |

(52) U.S. Cl.

CPC ..... *D21F 9/003* (2013.01); *D21F 1/52* (2013.01); *D21F 3/0209* (2013.01); *D21F 5/048* (2013.01); *D21F 11/002* (2013.01)

(58) Field of Classification Search

CPC ..... D21F 1/028; D21F 3/045; D21F 5/048; D21F 1/52; D21F 9/003; D21F 3/0209; D21F 11/002; D21F 9/00

USPC ..... 162/210

See application file for complete search history.

(56) References Cited

U.S. PATENT DOCUMENTS

| | | | |
|---|---|---|---|
| 4,976,820 | A | 12/1990 | Laapotti |
| 6,238,518 | B1 | 5/2001 | Rokman et al. |
| 6,503,372 | B1 | 1/2003 | Rokman et al. |
| 2010/0187171 | A1 | 7/2010 | Gupta |
| 2010/0187712 | A1 | 7/2010 | Gupta et al. |

FOREIGN PATENT DOCUMENTS

| | | | |
|---|---|---|---|
| CN | 1096551 | A | 12/1994 |
| CN | 101180437 | A | 5/2008 |
| CN | 101338530 | A | 1/2009 |
| CN | 101778975 | A | 7/2010 |
| CN | 102066661 | A | 5/2011 |
| CN | 102159767 | A | 8/2011 |
| CN | 105291500 | A | 2/2016 |
| DE | 102012202535 | A1 | 8/2012 |
| EP | 2063021 | A1 | 5/2009 |
| EP | 2722434 | A1 | 4/2014 |
| EP | 2722437 | A1 | 4/2014 |
| WO | WO2006125856 | A1 | 11/2006 |
| WO | WO2009024186 | A1 | 2/2009 |
| WO | WO2009129842 | A1 | 10/2009 |
| WO | WO2009129843 | A1 | 10/2009 |
| WO | WO2015187831 | A1 | 12/2015 |

*Primary Examiner* — Mark Halpern

(74) *Attorney, Agent, or Firm* — Laine IP Oy

(57) ABSTRACT

An apparatus and a method which heat an elongated product in at least two pulses including at least one first pulse wherein the product is pressed for at least 10 ms on a first pressure and at least one second heating and smoothing pulse wherein the product is pressed and/or heated at least for 10 ms on a pressure that is higher than the first pressure. The heating elements being arranged to heat the elongated product so that the heating the heating temperature is at least 80° C. on at least one surface of the elongated product.

19 Claims, 3 Drawing Sheets

| Quantity | Foam forming | Metal belt pressing and drying | Foam forming and metal belt pressing and drying | Effect |
|---|---|---|---|---|
| Dryness after press, changes in dryness % | + 1-5 % | + 6-14 % | + 10-20 % | Increased production, lower investment & production costs |
| Bulk after press, relative change | + 10-15 % | + 12-30 % | + 15-45 % With z-foaming up to + 80 % | Raw material savings |
| Smoothness after press, relative change | + 5-30 % | + 35-75 % | + 40-85 % | Improved properties, less need for calandering |

FIG. 3

METHOD AND APPARATUS FOR PRODUCING A FIBER WEB

BACKGROUND

The invention concerns method and apparatus for producing elongate fiber products, especially from a furnish comprising cellulosic pulp from plant materials. The products may be webs, yarns, fabrics or similar.

Producing webs or other products from fibers is basics of paper and board manufacture. Most manufacturing methods include making a mix of fibers, water and fillers and additives (furnish) and feeding furnish on a permeable surface to remove water and form a web of entangled fibers that are held together by chemical bonds and mechanical forces. Furnish may be foamed to provide specific formation characteristics. The web is usually rather wet after formation and further water removal is needed. This can be done mechanically in a pressing nip or by heating by various methods. Different formation and water removal methods are combined in order to obtain desired end products and designing the manufacturing process defines the product range that can be manufactured.

Various methods and processes for water removal are described in publications WO 2009024186, EP 2722437, EP 2063021, EP 2722434.

Known methods for producing webs, fabrics, yarns and such products from fibers have their characteristic strengths and drawbacks. Some methods are suitable for cellulosic material and others better suitable for artificial fibers or mixtures of these fibers. Therefore, there is need for novel methods for manufacture of these products.

SUMMARY OF THE INVENTION

The invention is defined by the features of the independent claims. Some specific embodiments are defined in the dependent claims.

According to a first aspect of the present invention, there is provided a method for removing water from an elongated product formed of fibers and water, comprising a pressing and heating step for removing water from the elongated product; wherein—the web is heated by heating elements between the felt and the belt in at least two pulses including at least one heating pulse wherein the product is pressed for at least 10 ms on a first pressure and at least one heating and smoothing pulse wherein the product is heated at least for 10 ms on a pressure that is higher than the first pressure.

According to a second aspect of the present invention, there is provided an apparatus for removing water from an elongated product formed of fibers and water, comprising: heating elements (11 or 13 or 14) and pressing elements (7, 9) for heating the elongated product in at least two pulses including at least one first pulse wherein the elongated product is pressed for at least 10 ms on a first pressure and at least one second heating and smoothing pulse wherein the elongated product is heated at least for 10 ms on a pressure that is higher than the first pressure.

According to a third aspect of the invention, there is provided an apparatus wherein at least one of pressing elements forming one of the surfaces pressing the elongated product being the smooth metal belt.

According to a fourth aspect of the invention, there is provided an apparatus wherein the first heating elements are adapted to press the elongated product 10-200 ms.

According to a fifth aspect of the invention there is provided an apparatus, wherein the metal belt and the product are arranged to run so that the product is against one or more heated rolls during a drying step.

According to a sixth aspect of the invention, there is provided an apparatus wherein the pressing and heating section comprises a felt and metal belt that are set to run against each other.

According to a seventh aspect of the invention, there is provided an apparatus, wherein the heating elements (11 or 13 or 14) are arranged to heat the product so that the heating temperature is at least 80° C. on at least one surface of the product According to an eight aspect of the invention, there is provided an apparatus according to any of the preceding claims, comprising heating and pressing elements for heating the belt in pulses comprising first pulse of 10-200 ms and 0.01±0.01 MPa, second pulse of 10-200 ms and 0.1±0.1 MPa, third pulse of 10-200 ms and 0.1-1 MPa, and fourth pulse 10-100 ms and 0.1-10 MPa.

According to a ninth aspect of the invention, there is provided an apparatus, wherein the felt and the belt are arranged to be pressed against each other in order to provide the first pulse.

According to a tenth aspect of the invention, there is provided an apparatus wherein the heating elements for heating the elongated product and the belt comprise at least one of the following: a heated roll against the elongated product and/or belt, a heater on the back side of the belt, a heater on the side of the belt against the elongated product.

According to an eleventh aspect of the invention, there is provided an apparatus wherein the elongated product is arranged to run around at least one heated roll supported by the belt for providing a heating and smoothing pulse in a drying step.

According to a twelfth aspect of the invention, an apparatus, wherein the elongated product is arranged to run around at more than one heated roll supported by the belt (9) for providing a heating and smoothing pulse or pulses in a drying step.

According to a thirteenth aspect of the invention, there is provided an apparatus comprising adjusting elements for controlling the tension of the felt and the metal belt pressure on the elongated product) and adjusting the steam pressure and condensate pressure to form an increasing adjustable pressure and temperature profile for heating the elongated product and removing water and smoothing the elongated product.

According to a fourteenth aspect of the invention, there is provided a method, wherein the first pulse is 10-200 ms.

According to a fifteenth aspect of the invention, there is provided a method wherein the second heating pulse is 10-200 ms.

According to a sixteenth aspect of the invention, there is provided a method wherein the temperature of the product entering to the pressing and drying step is gradually increased from incoming temperature of 30-60° C. to a drying temperature of 80-100° C.

According to the seventeenth aspect of the invention, there is provided a method wherein the tension of the felt and the metal belt pressure on the elongated product), steam pressure and condensate pressure are adjusted to form an increasing adjustable pressure and temperature profile, which heats the elongated product and removes water and smoothens the elongated product.

According to the eighteenth aspect of the invention, there is provided a method, wherein the elongated product is heated at least in one stage by a chamber having adjustable seals and separate steam heating and pressurized condensate areas of increasing pressure and adjustable sealed excess water removal area.

BRIEF DESCRIPTION OF THE DRAWINGS

FIG. 3 illustrates results of comparative test showing products made by some embodiments of the invention and known methods.

EMBODIMENTS

Definitions

In the present context, the term "fiber" comprises cellulosic fibers obtained from plants and artificial fibers.

The invention relates to production of paper and board webs, tissue, yarns, nonwovens and other such products made of cellulosic fibers, or artificial fibers and mixtures thereof. These products are generally made of aqueous furnish of fibers that is spread on a fabric to form a product and subsequently dried by pressure and heat. The purpose of at least some of the embodiments of the invention is to provide new approaches to formation and drying process of the product in order to provide at least some new, improved products and/or changes or improvements to the manufacturing process.

In the following the word "web" is used to nominate the product to be manufactured. This nomination is used for simplicity only and is to be considered to encompass all elongated fiber products mentioned above and below if another nomination is not specifically used.

Figure 1:
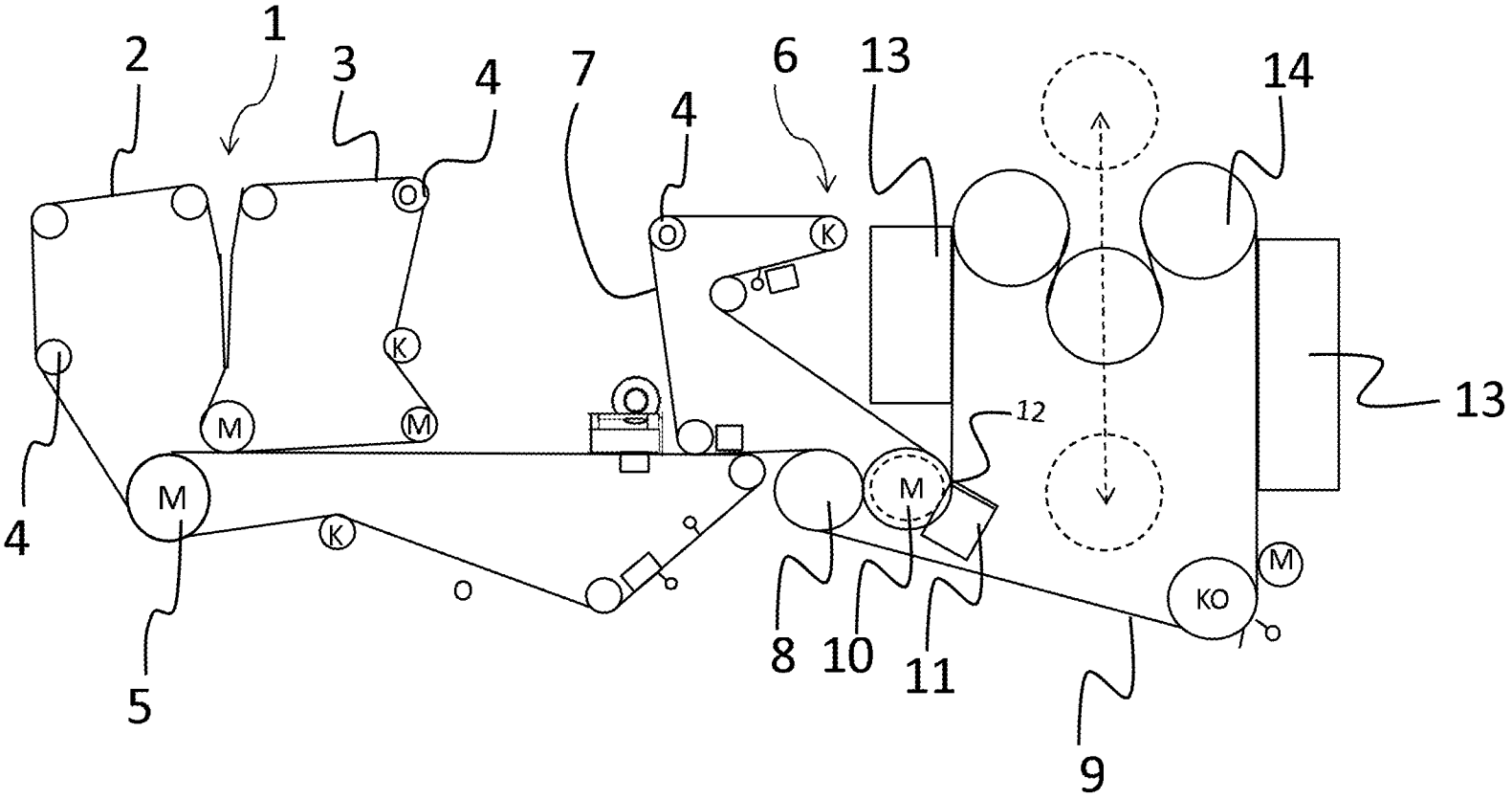
FIG. 1 illustrates schematically a web production process in accordance with at least some embodiments of the present invention.

FIG. 1 illustrates a production method and apparatus in accordance with at least some embodiments of the present invention. The formation step 1 is shown here as a general illustration of two fabrics 2, 3 that are set to run opposite to each other through guide 4 and driving 5 rolls. First of the fabrics 2 is arranged to run to a pressing felt 7 of a pressing and heating step 6. The web is taken on the first fabric 2 to the pressing felt 7 by means of vacuum. The pressing felt 7 is arranged to run so that it forms a nip with the first fabric 2. The web is transferred to the felt 7 on this nip. It is also possible to apply a combined long fabric i.e. felt or structured fabric as a long loop instead of fabrics 3 and 7 that transfers the web from forming to pressing and drying especially in tissue type of web applications. Next in the running direction of the felt 7 is a guide roll 8 of a metallic belt 9. The felt 7 and the metallic belt 9 form a nip and here the web is caught between the felt 7 and the belt 9. From the guide roll 8 the felt 7, belt 9 and the web that is placed therebetween are transferred downstream so that the web is following the metal belt on the metal belt 9 surface. The web is passed on the surface of the metal belt around heated rolls 14 so that at least one of heated rolls is on the web side and one on the back side of the metal belt. These rolls 14 may be heated with steam or other heating means such as induction but steam provides good heat transfer and adjustability. As steam heated rolls are readily available, they provide a recommendable alternative for controlled heating of the web. The web runs between the felt 7 and belt 9 around the grooved roll 10 and heated rolls 14. Here water is removed from the web in a controlled manner. The roll 10 is roll that is designed for removing liquid, usually water in paper, board or non-woven manufacture. The roll 10 is a called a grooved roll herein but may be a perforated roll or otherwise provided with passages for producing sufficient space for water removal so that the surface of the roll can receive the large amount of water that is removed from the web to the surface of the grooved roll 10 through the felt 7. The may heat during some manufacturing processes. Thus it may be provided with cooling system in order to keep lubrication conditions between the inner surface of the grooved roll 10 and the supporting surface inside the grooved roll sufficient in a continuous process where the temperature of the grooved roll may increase. The cooling of the grooved roll 10 may be provided by directing excess heat energy for heating warm waters needed in the process. This can be realized by a heat exchanger placed in the lubrication oil tank of the grooved roll.

The metal belt 9 is heated in this embodiment first by a pressurized steam chamber 11 positioned against the grooved roll 10 so that it covers the belt 9 on the opposite side of the belt 9 in view of the web and the felt 7. The steam chamber 11 is located so that it covers the belt 9 downstream from the exit point 12 of the belt 9 from the grooved roll 10. Upstream to the exit point 12 are arranged heaters 13 that are directed towards the belt 9 on the side that the web travels. In this embodiment there are two heaters 13. These may be any heaters or dryers used in the industry, for example steam dryers, impingement dryers, infrared dryers or induction heaters for heating the metal web. The metal belt should have some thermal energy (heat) when it returns to the guide roll 8 and contacts the web. In addition to these heaters 13, three heated rolls 14 are arranged between the heaters 13. The belt 9 and the web on the belt run around the heated rolls 14 and is further dried and smoothened in the process. The belt and the web may be arranged to run so that the web is against one or more of the heated rolls 14 during this drying step. In this way the web may be pressed against the roll for increasing the smoothness and dryness. The pressure and the surface of the roll can be adjusted and chosen so that desired level of smoothness and dryness is achieved and web shrinkage is prevented and also curling can be controlled.

The drying and smoothing pulse is achieved in the above described embodiment by using following arrangements and parameters:

1) The web is arranged to run between a felt 7 and a smooth hot metal belt 9
2) Felt 7 and metal belt 9 tension (pressure on the web), steam pressure and condensate pressure are adjusted to form a very long slowly increasing adjustable pressure and temperature profile, which heats the web and removes water and smoothens the web
3) Chamber 11 has adjustable seals and separate steam heating and pressurized condensate areas of increasing pressure and adjustable sealed excess water removal area to form the end of the pulse The above described smoothening and heating pulse enables higher production and quality as well as decreases production and investment costs. If the described embodiments of the pulse are combined with foam forming techniques described below, huge improvement step is possible. Available advantages are high dryness, bulk and smoothness of the web compared to presently used heating and drying methods.

Figure 2:
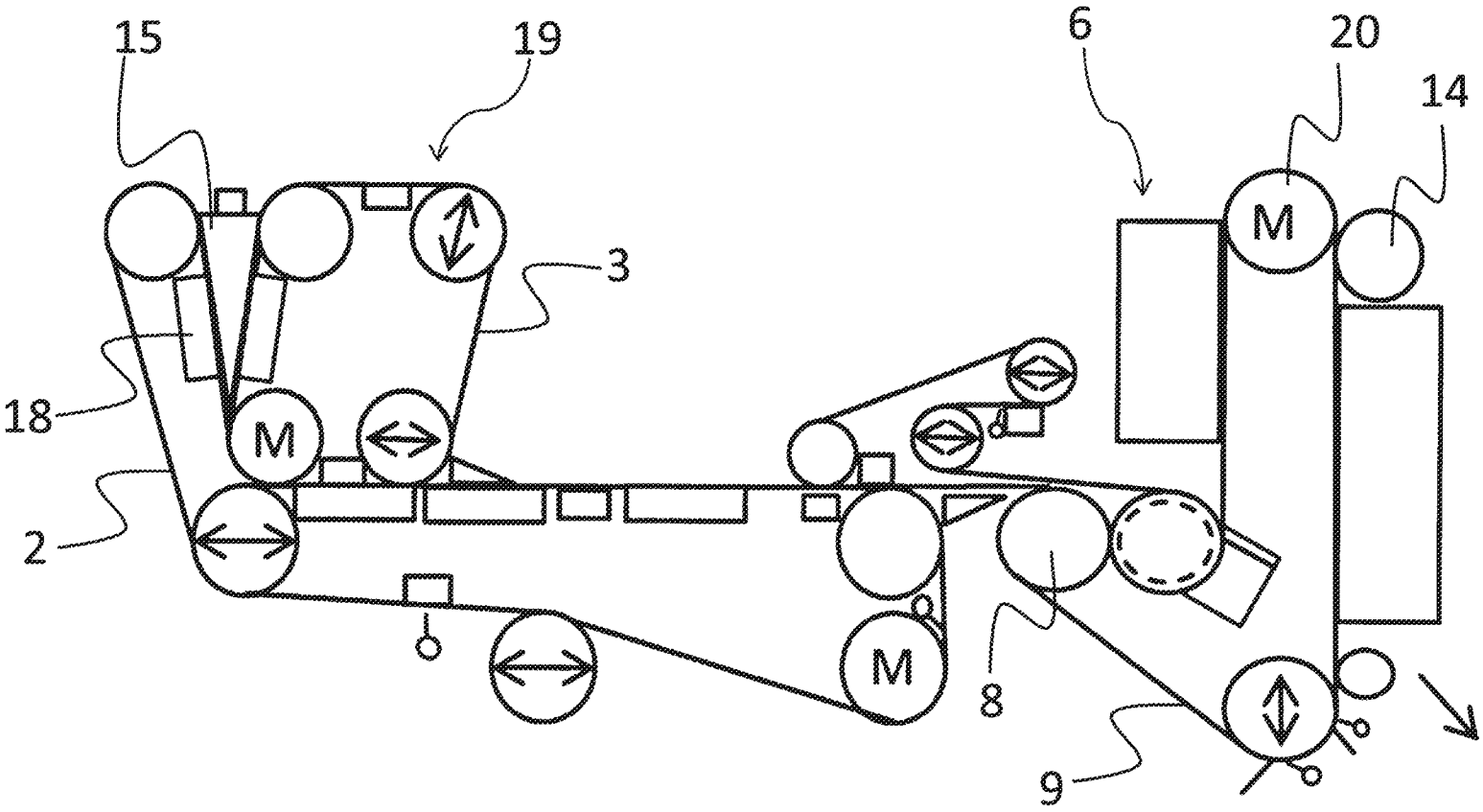
FIG. 2 illustrates an example apparatus capable of supporting at least some embodiments of the present invention.

FIG. 2 illustrates an embodiment wherein a former apparatus may be utilized. The former apparatus 19 is arranged first in the upstream direction of the production process at the formation step 1 (FIG. 1). At this step furnish is fed to the nip of the fabrics 2, 3 in order to give form to the product that is manufactured. Some of the applicable forms are narrow strips for yarns, wider strips or webs for paper, board, fabric or non-woven products. After the formation step the product is transferred to the pressing and heating stage 6. In this stage pressing and heating is performed as described above. Only difference is that instead of set of heated rolls 14 only one heated roll 14 is used. This heated roll 14 is arranged to form a nip with a drive roll 20 of the belt 9 providing a smoothing nip.

The features of above described embodiments in method and apparatus for feeding the furnish may be further emphasized by using foamed furnish. Foaming aids control of viscosity and fiber orientation.

In the following, features of the embodiments of the invention are summarized and further clarified. It must be noted that the invention provides several possibilities to implement its various embodiments and all of the features described below are possibly not realizable in all of the embodiments.

One feature characterizing most embodiments relating to water removal and drying is achieving predescribed temperatures and pressures on the pressing section for a long enough time. Some benefits obtained by embodiments of the invention are higher bulk, thickness, higher DMC (dry matter content) during manufacture and improved smoothness. Some of these benefits are presented in FIG. 3. Further tests have shown that for a predetermined smoothness level the increase in bulk may be even higher in comparison to known method used in the test. The reason for this is that some embodiments of the invention allow production of a web having high bulk and smoothness using a single pressing step. Known methods require 2-4 pressing nips and calandering in 1-3 calandering nips in order to achieve same levels of smoothness achievable with some embodiments of the invention. Several pressing stages and calandering lead to loss of bulk as is well known in the art. Both of the above described pressing method and apparatus aim to higher dry matter contents than previously used in the art. New pressing technology provides DMC levels of 40-65% after pressing compared to characteristic level of 30-55% of the known art.

In order to achieve high bulk it is beneficial to use very low pressure in the pressing nip. Maximum pressure of 0.1-1 MPa can be used in the pressing nip combined to a long heated pressure pulse. Using low pressure makes it easier to accomplish the machinery of the pressing stage as lighter structures can be used and lower pressures are easier to seal. The embodiments of the invention may replace a large, expensive multi-level wire section, multi-nip felt pressing section and a long drying section comprising several drying cylinders as well as a multi-nip calander. The embodiments of the invention provide a simpler, shorter and more efficient machinery comprising less felts and components needing maintenance.

The temperature of the web may rise above 80° C. for thin products and already during first 10-30 ms of a thin web in the contact between metal belt and a felt. On the other hand, for very thick products like heavy cardboard it may happen that the felt side of the web doesn't achieve the temperature of 80° C. in the pressing nip. Typically, the pressing pulse is 10-200 ms 0.01±0.01 MPa+10-200 ms 0.1±0.1 MPa+10-200 ms 0.1-1 MPa+10-100 ms 0.1-10 MPa. The side of the web that is against the metal belt achieves a temperature of about 80-110° C. and the felt side about 50-90° C. at the pressing nip. In practice some cooler water is first removed from the web to the felt and thereafter heated water, that especially for thin webs (tissue, paper, board) heat the felt significantly. The temperature of the felt may increase to a level of 50-80° C. As the temperature of the web is typically about 30-60° C. when it arrives to the nip from the wire section, the web heats in practice on both sides immediately when it arrives to the first contact between the felt and the metal belt.

In summary, the combination of various embodiments of the invention provides a production method including following steps: 1) Feeding fibers and additives, 2) moving the web by suction using decreased pressure of 5-70 kPa from the wire fabric to a pressing felt 4) heating the web and transferring water to the felt, the web is transferred to the pressing section, 5) initial pressing 1: achieved by tension of the felt against the metal belt and a roll, 6) initial pressing 2: tension of the metal belt against the felt and the roll, 7) increasing the temperature of the metal belt and actual pressing 1: tension of the metal belt and steam pressure against felt and the roll, 8) actual pressing 2: tension of the metal belt and pressurized water against felt and the roll, 9) drying of the web on the metal belt, preferably impingement dryers for increasing the evaporation on the side of the web opposite to the belt, 10) further heating of the metal belt by a steam cylinder, 11) heating and smoothing of the web by a steam cylinder, 12) repeating phases 9-11 for achieving desired level of bulk, DMC, smoothness etc., 13) removing the web from the metal belt of crepping for tissue, 14) further processing, for example sizing, coating, further calandering patterning, embossing, slitting etc.

Experimental Results

FIG. 3 shows changes in web properties of webs made according to the embodiments of the invention in relation to webs made using known methods. The FIG. 34 shows that each stage, foam forming, metal belt pressing and drying and combination thereof provides notable improvements in dryness after press, bulk after press and smoothness after press. The features benefit for increased production, lower investment and production costs, savings in raw materials and improves properties.

Some of the specific aspects of the invention are listed below as examples:

According to one aspect of the invention there is provided a method producing elongate fiber products wherein furnish of fibers and water is formed to an elongate product and subsequently transferred to a drying step including at least two pulses including at least one heating pulse wherein the product is pressed for at least 10 ms on a first pressure and at least one heating and smoothing pulse wherein the product is heated at least for 10-200 ms on a pressure that is higher than the first pressure, the heating temperature being at least 80° C. on at least one surface of the product and at least one of the surfaces pressing the product being a smooth belt.

According to another aspect of the invention, the temperature of the product entering to the pressing and heating step is gradually increased from incoming temperature of 30-80° C. to a drying temperature of 80-100° C.

According to a further aspect of the invention, there is provided a method and apparatus comprising a forming section for feeding an aqueous furnish of fibers on a moving surface to form a shape of a product and a pressing and heating section for removing water from the shaped product received from the moving surface, wherein the pressing and heating section comprises a felt and metal belt that are set to run against each other for receiving the furnish from the moving surface, and heating elements for heating the web between the felt and the belt in at least two pulses including at least one heating pulse wherein the product is pressed for at least 10 ms on a first pressure and at least one heating and smoothing pulse wherein the product is heated at least for 10-200 ms on a pressure that is higher than the first pressure, the heating temperature being at least 80° C. on at least one surface of the product and at least one of the surfaces pressing the product being the smooth metal belt.

According to a still further aspect of the invention, there is provided an apparatus, wherein the heating elements for heating the web comprise at least one roll against which the felt and the belt are arranged to run and at least one heater for heating the belt.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in board, paper, tissue and non-woven industry.

ACRONYMS LIST

DMC is dry matter content

The invention claimed is:

1. An apparatus for removing water from an elongated product formed of fibers and water, comprising:

heating elements and pressing elements for heating the elongated product in at least two pulses including at least one first pulse wherein the elongated product is pressed and heated for at least 10 milliseconds on a first pressure and at least one second heating and smoothing pulse wherein the elongated product is pressed and/or heated at least for 10 milliseconds on a pressure that is higher than the first pressure, and the heating elements are arranged to heat the elongated product so that the heating temperature is at least 80° C. on at least one surface of the elongated product.

2. The apparatus according to the claim 1, wherein at least one of pressing elements forming one of the surfaces pressing the elongated product being a metal belt.

3. The apparatus according to claim 2, further comprising heating and pressing elements for heating the metal belt in pulses comprising first pulse of 10-200 milliseconds and 0.01±0.01 megapascals, second pulse of 10-200 milliseconds and 0.1±0.1 megapascals, third pulse of 10-200 milliseconds and 0.1-1 megapascals, and fourth pulse 10-100 milliseconds and 0.1-10 megapascals.

4. The apparatus according to claim 2, further comprising adjusting elements for controlling the tension of a pressing felt and the metal belt and adjusting the steam pressure and condensate pressure to form an increasing adjustable pressure and temperature profile for heating the elongated product and removing water and smoothing the elongated product.

5. The apparatus according to claim 1, wherein the first heating elements are adapted to heat and/or press the elongated product 10-200 milliseconds.

6. The apparatus according to claim 1, further comprising elements for moving the elongated product by suction using decreased pressure from a wire fabric to a pressing felt, heating the elongated product and transferring water to the pressing felt.

7. A method for removing water from an elongated product formed of fibers and water, comprising:

a pressing and heating step for removing water from the elongated product;

wherein the elongated product is pressed and heated by heating elements in at least two pulses including at least one pressing pulse wherein the product is pressed for at least 10 milliseconds on a first pressure and at least one second heating and smoothing pulse wherein the product is heated and/or pressed at least for 10 milliseconds on a pressure that is higher than the first pressure, and the elongated product is heated so that the heating temperature is at least 80° C. on at least one surface of the elongated product.

8. The method according to the claim 7, wherein the elongated product is heated and pressed between a pressing felt and a belt.

9. The method according to claim 8, wherein the pressing felt and the belt are arranged to be pressed against each other in order to provide the first pulse.

10. The method according to claim 8, wherein a side of the elongated product that is against the belt is heated to a temperature of about 80-110° C. and the felt side about 50-90° C. at the pressing nip.

11. The method according to claim 8, further comprising moving the elongated product by suction using decreased pressure from a wire fabric to the pressing felt, heating the elongated product and transferring water to the pressing felt.

12. The method according to the claim 7, wherein at least one of the surfaces pressing the elongated product is a metal belt.

13. The method according to the claim 7, wherein at least one of the surfaces pressing the elongated product is a smooth metal belt.

14. The method according to claim 7, wherein the first pulse is 10-3200 milliseconds.

15. The method according to claim 7, wherein the second heating pulse is 10-200 milliseconds.

16. The method according to claim 7, wherein the temperature of the elongated product entering to the pressing and drying step is gradually increased from incoming temperature of 30-60° C. to a drying temperature of 80-100° C.

17. The method according to claim 7, wherein the elongated product is heated by the heating elements to a temperature reaching at least 80° C. on at least one surface of the elongated product.

18. The method according to claim 7, further comprising heating and pressing the elongated product in pulses comprising first pulse of 10-200 milliseconds and 0.01±0.01 megapascals, second pulse of 10-200 milliseconds and 0.1±0.1 megapascals, third pulse of 10-200 milliseconds and 0.1-1 megapascals, and fourth pulse 10-100 milliseconds and 0.1-10 megapascals.

19. The method according to claim 7, wherein the tension of the felt and the metal belt, steam pressure and condensate pressure are adjusted to form an increasing adjustable pressure and temperature profile, which heats the elongated product and removes water and smoothens the elongated product.

* * * * *